US009354559B2

(12) United States Patent
Nakamura et al.

(10) Patent No.: US 9,354,559 B2
(45) Date of Patent: May 31, 2016

(54) CLEANING BLADE, PROCESS CARTRIDGE, AND IMAGE FORMING APPARATUS

(71) Applicant: FUJI XEROX CO., LTD., Tokyo (JP)

(72) Inventors: Yu Nakamura, Kanagawa (JP); Daisuke Tano, Kanagawa (JP); Masato Ono, Kanagawa (JP); Shintaro Kikuchi, Kanagawa (JP); Yuko Kawase, Kanagawa (JP); Noriaki Kojima, Kanagawa (JP); Tsutomu Sugimoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/606,570

(22) Filed: Jan. 27, 2015

(65) Prior Publication Data

US 2016/0004190 A1 Jan. 7, 2016

(30) Foreign Application Priority Data

Jul. 1, 2014 (JP) ..... 2014-136195

(51) Int. Cl.

| | |
|---|---|
| ***G03G 15/16*** | (2006.01) |
| ***B08B 1/00*** | (2006.01) |
| ***G03G 21/00*** | (2006.01) |
| *G03G 15/01* | (2006.01) |

(52) U.S. Cl.

CPC ..... *G03G 15/161* (2013.01); *B08B 1/001* (2013.01); *G03G 21/0017* (2013.01); *B08B 1/005* (2013.01); *G03G 15/0131* (2013.01); *G03G 15/168* (2013.01); *G03G 2215/1652* (2013.01); *G03G 2215/1661* (2013.01)

(58) Field of Classification Search

CPC ..... G03G 15/16
USPC ..... 399/101, 105, 123
See application file for complete search history.

(56) References Cited

U.S. PATENT DOCUMENTS

| | | | | | |
|---|---|---|---|---|---|
| 5,450,184 | A * | 9/1995 | Yanai | G03G 21/0017 | 15/256.5 |
| 5,510,887 | A * | 4/1996 | Watabe | C08G 18/10 | 399/350 |
| 6,282,401 | B1 * | 8/2001 | Proulx | G03G 21/0017 | 399/350 |
| 6,473,589 | B2 * | 10/2002 | Hisakuni | G03G 21/0017 | 399/350 |
| 7,715,778 | B2 * | 5/2010 | Sugimoto | G03G 21/0017 | 15/256.5 |
| 7,848,694 | B2 * | 12/2010 | Nakatake | G03G 21/0017 | 399/123 |
| 8,170,441 | B2 * | 5/2012 | Ferrar | G03G 15/161 | 399/101 |
| 8,781,384 | B2 * | 7/2014 | Kashiwakura | G03G 21/0017 | 399/159 |
| 2002/0192430 | A1 * | 12/2002 | Miura | C08G 18/163 | 428/157 |
| 2005/0268424 | A1 * | 12/2005 | Omori | C08G 18/089 | 15/256.5 |
| 2006/0004174 | A1 * | 1/2006 | Omori | C08G 18/4202 | 528/44 |
| 2006/0140692 | A1 * | 6/2006 | Abe | G03G 21/0017 | 399/350 |
| 2006/0216084 | A1 * | 9/2006 | Kojima | G03G 21/0017 | 399/350 |

(Continued)

FOREIGN PATENT DOCUMENTS

| | | | | |
|---|---|---|---|---|
| JP | H05-119676 A | | 5/1993 | |
| JP | 2010-134111 | * | 6/2010 | G03G 15/00 |
| JP | 2010134111 A | | 6/2010 | |

*Primary Examiner* — Clayton E LaBalle
*Assistant Examiner* — Kevin Butler
(74) *Attorney, Agent, or Firm* — Oliff PLC

(57) ABSTRACT

Disclosed is a cleaning blade of which a contact portion brought into contact with at least a member to be cleaned is formed of a polyurethane member that includes a polyurethane material containing a hard segment and a soft segment and has a ratio of an area occupied by a hard segment aggregate having a diameter of 0.3 μm to 0.7 μm in a cross section being in a range of 2% to 10%.

12 Claims, 6 Drawing Sheets

(56) References Cited

U.S. PATENT DOCUMENTS

2008/0025775 A1* 1/2008 Hays ..... G03G 21/0017 399/350
2008/0027184 A1* 1/2008 Ueno ..... C08G 18/3868 525/459
2009/0003905 A1* 1/2009 Ueno ..... G03G 21/0017 399/350
2010/0028045 A1* 2/2010 Kawakami ..... G03G 21/0011 399/123
2010/0150628 A1* 6/2010 Miki ..... B29C 41/003 399/350
2011/0135361 A1* 6/2011 Kabata ..... G03G 21/0017 399/350
2014/0086653 A1* 3/2014 Tano ..... G03G 21/0017 399/350
2014/0153987 A1* 6/2014 Jeong ..... G03G 21/0011 399/350
2014/0255070 A1* 9/2014 Tano ..... G03G 21/0017 399/350
2015/0117896 A1* 4/2015 Sugimoto ..... G03G 15/161 399/101
2015/0125177 A1* 5/2015 Yu ..... G03G 21/0017 399/101

* cited by examiner

CLEANING BLADE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2014-136195 filed Jul. 1, 2014.

BACKGROUND

1. Technical Field

The present invention relates to a cleaning blade, a process cartridge, and an image forming apparatus.

2. Related Art

In the related art, in a copying machine, a printer, and a facsimile having an electrophotographic system, a cleaning blade has been used as a cleaning unit that removes a residual toner or the like on a surface of an image holding member such as a photoreceptor.

SUMMARY

According to an aspect of the invention, there is provided a cleaning blade of which a contact portion brought into contact with at least a member to be cleaned is formed of a polyurethane member that includes a polyurethane material containing a hard segment and a soft segment and has a ratio of an area occupied by a hard segment aggregate having a diameter of 0.3 μm to 0.7 μm in a cross section being in a range of 2% to 10%.

BRIEF DESCRIPTION OF THE DRAWINGS

Exemplary embodiments of the present invention will be described in detail based on the following figures, wherein.

DETAILED DESCRIPTION

Figure 1:
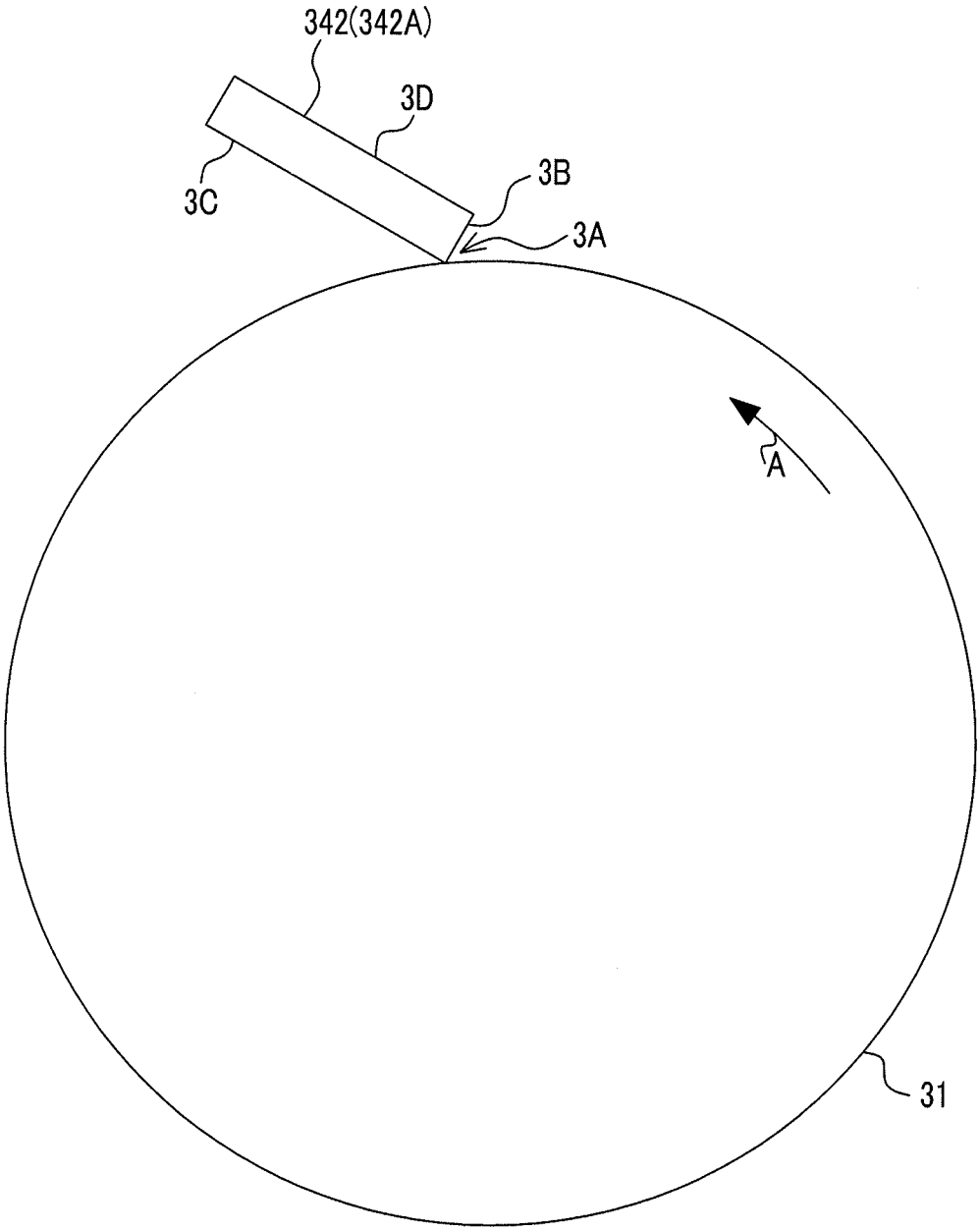
FIG. 1 is a view schematically illustrating an example of a cleaning blade according to the present exemplary embodiment.

Hereinafter, exemplary embodiments of a cleaning blade, a cleaning device, a process cartridge, and an image forming apparatus of the present invention will be described in detail.

Cleaning Blade

In the cleaning blade according to the present exemplary embodiment, at least a contact portion in contact with a member to be cleaned is formed of a polyurethane member including a polyurethane material that contains a hard segment and a soft segment. Further, in the polyurethane member, the ratio of an area occupied by a hard segment aggregate having a diameter of 0.3 μm to 0.7 μm in the cross section is in the range of 2% to 10%.

In addition, the term "hard segment aggregate" means a domain formed by the hard segment, which is contained in a polyurethane material, being aggregated.

In the related art, excellent abrasion resistance has been required for the cleaning blade from a viewpoint of a long service life. Further, when partial cracking occurs by stress being locally applied to a part of the contact portion between the cleaning blade and the member to be cleaned, since cleaning is not performed in the chipped portion, crack resistance property with respect to local stress has been required.

In a normal cleaning blade formed of a polyurethane member, when molecular mobility of the polyurethane member is improved, low-temperature characteristics are improved and the glass transition temperature thereof is decreased, and crack resistance property is sufficiently provided. However, since the hardness of the cleaning blade decreases when the molecular mobility is improved, the abrasion resistance is deteriorated. That is, the crack resistance property and the abrasion resistance are inconsistent with each other.

Meanwhile, in the cleaning blade according to the present exemplary embodiment, since the ratio of the area occupied by a hard segment aggregate having a diameter of 0.3 μm to 0.7 μm is in the range of 2% to 10% in a polyurethane member constituting a contact portion at least being in contact with a member to be cleaned, both of the crack resistance property and the abrasion resistance may be obtained.

The reason thereof is not necessarily clear, but may be assumed as follows.

That is, the polyurethane member has hard segments and soft segments in a molecular structure, and both of them form a sea-island structure by hard segments being scattered in soft segments. Further, it is considered that harder hard segments contribute to hardness, that is, abrasion resistance as the hard segments become harder. On the contrary, it is considered that softer soft segments contribute molecular mobility, that is, crack resistance property as the soft segments becomes softer.

However, it is considered that since the distance between soft segments present between hard segments becomes relatively short when the diameter of the hard segment aggregate is small and hard segments are excessively scattered, the molecular mobility of the soft segments are obstructed by the hard segments and thus crack resistance property may be deteriorated.

On the contrary, it is considered that the distance between soft segments present between hard segments becomes relatively long when the hard segments are moderately aggregated and the number of the hard segments is reduced without reducing the total amount of the hard segments, and an obstruction of the molecular mobility of the soft segments due to the hard segments is alleviated and the crack resistance property is improved. Further, it is considered that since the total amount of the hard segments is not reduced, the hardness is not changed, that is, the abrasion resistance is preferably maintained.

However, it is considered that aggregated masses of the hard segments become excessively large and the surface area of the entirety of hard segments becomes small when the aggregation of the hard segments is excessively progressed, and cracking on the interface between the hard segment and the soft segment easily occurs.

Further, the hard segment having a diameter of 0.3 μm to 0.7 μm defined in the present exemplary embodiment represents a state in which the hard segments are moderately aggregated.

That is, it is estimated that the ratio of the moderately aggregated hard segments is adjusted to be in a moderate range in the cleaning blade according to the present exemplary embodiment whose ratio of an area occupied by the hard segment aggregate having a diameter within the above range is in the range of 2% to 10%, so that excellent abrasion resistance may be obtained and crack resistance property is improved.

Hard Segment Aggregate Having a Diameter of 0.3 μm to 0.7 μm

In the polyurethane member, the ratio of an area occupied by the hard segment aggregate having a diameter of 0.3 μm to 0.7 μm in the cross section is in the range of 2% to 10%. In addition, the ratio of the area is more preferably in the range of 2% to 7% and still more preferably in the range of 2% to 5%.

When the ratio of an area of the hard segment aggregate having a diameter of 0.3 μm to 0.7 μm is less than 2%, the crack resistance property may be deteriorated. Meanwhile, when the ratio of the area exceeds 10%, the abrasion resistance may be deteriorated.

Hard Segment Aggregate Having a Diameter of 0.1 μm to Less than 0.3 μm

In the polyurethane member, the ratio of an area occupied by the hard segment aggregate having a diameter of 0.1 μm to less than 0.3 μm in the cross section is preferably in the range of 0.005% to 5%. The ratio of the area is more preferably in the range of 0.005% to 3% and still more preferably in the range of 0.01% to 2%.

The hard segment aggregate having a diameter of 0.1 μm to less than 0.3 μm represents a state in which the diameter of the hard segment aggregates is small and hard segments are excessively dispersed. When the ratio of the hard segment aggregate having a diameter of 0.1 μm to less than 0.3 μm is in the above-described range, the ratio of the hard segment aggregates in the state in which hard segments with a small diameter are excessively dispersed is reduced and thus excellent crack resistance property may be obtained.

Hard Segment Aggregate Having a Diameter of More than 0.7 μm

In the polyurethane member, the ratio of an area occupied by the hard segment aggregate having a diameter of more than 0.7 μm in the cross section is preferably in the range of 0.005% to 3%. The ratio of the area is more preferably in the range of 0.005% to 2% and still more preferably in the range of 0.005% to 1%.

The hard segment aggregate having a diameter of more than 0.7 μm represents a state in which the aggregation of the hard segments is excessively progressed. When the ratio of the hard segment aggregate having a diameter of more than 0.7 μm is in the above-described range, the ratio of the hard segment aggregates in the state in which the aggregation of the hard segments is excessively progressed is reduced and thus excellent crack resistance property may be obtained.

Diameter of Hard Segment Aggregate and Calculation of Ratio of Area

In the cross section of the polyurethane member, the ratio of an area occupied by the hard segment aggregate having a diameter of 0.1 μm to less than 0.3 μm, the ratio of an area occupied by the hard segment aggregate having a diameter of 0.3 μm to 0.7 μm, and the ratio of an area occupied by the hard segment aggregate having a diameter of more than 0.7 μm are calculated through observation using an atomic force microscope (AFM). That is, an image is observed using an atomic force microscope (AFM, trade name: S-image/NanoNavi2, manufactured by Hitachi High-Tech Science Corporation) on an arbitrary cross section of the polyurethane member, and the ratios of the hard segment aggregates having a diameter of 0.1 μm to less than 0.3 μm, a diameter of 0.3 μm to 0.7 μm, and a diameter of more than 0.7 μm in the image are calculated as area ratios. In addition, the above-described observation is performed on cross-sections of three arbitrary surfaces and the average value thereof is employed.

Method of Achieving Diameters and Area Ratios of Hard Segment Aggregates

Further, the ratio of an area occupied by the hard segment aggregate having a diameter of 0.1 μm to less than 0.3 μm, the ratio of an area occupied by the hard segment aggregate having a diameter of 0.1 μm to less than 0.3 μm, and the ratio of an area occupied by the hard segment aggregate having a diameter of more than 0.7 μm are controlled by adjusting the degree of aggregation of hard segments of the polyurethane member. Further, as a specific example of the method, which is not particularly limited, a method of forming a polyurethane member of a cleaning blade and then performing a post-heating process may be exemplified. The hard segments are aggregated by carrying out heating and the degree of aggregation is appropriately controlled by adjusting the degree of the heating, that is, the temperature or the time of the heating.

Next, the configuration of the cleaning blade according to the present exemplary embodiment will be described.

Figure 2:
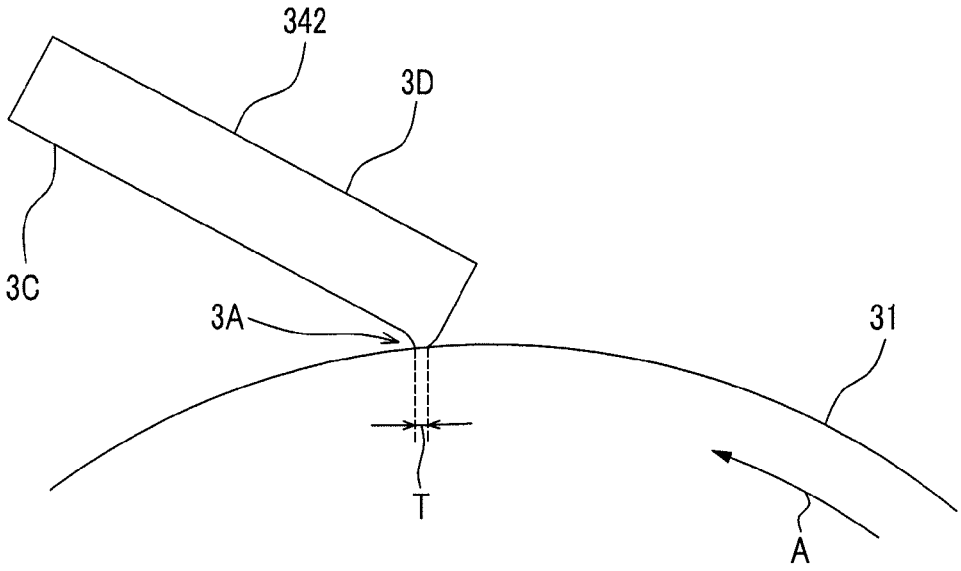
FIG. 2 is a view schematically illustrating a state in which the cleaning blade according to the present exemplary embodiment is brought into contact with a driving image holding member.

Further, the cleaning blade according to the present exemplary embodiment is arranged by being brought into contact with the surface of a member 31 to be cleaned as illustrated in FIG. 1. When the member 31 to be cleaned is driven, as illustrated in FIG. 2, sliding occurs in a contact portion between a cleaning blade 342 and the member 31 to be cleaned and a nip portion T is formed, and then the surface of the member 31 to be cleaned is cleaned.

First, each portion of the cleaning blade will be described with reference to the figures. Hereinafter, as illustrated in FIG. 1, the cleaning blade includes a contact angle portion 3A that performs cleaning of the surface of the member (image holding member) 31 to be cleaned by being brought into contact with the driving member (image holding member/photoreceptor drum) 31 to be cleaned; a tip surface 3B in which the contact angle portion 3A constitutes one side thereof and which is directed to the upstream side in the driving direction (a direction of an arrow A); a ventral surface 3C in which the contact angle portion 3A constitutes one side thereof and which is directed to the downstream side in the driving direction (a direction of an arrow A); and a rear surface 3D that shares one side with the tip surface 3B and faces the ventral surface 3C.

Further, a direction (depth direction in FIG. 1) along the direction in which the contact angle portion 3A is brought into contact with the member 31 to be cleaned is referred to as a depth direction, a direction to the side with the tip surface 3B formed from the contact angle portion 3A is referred to as a thickness direction, and a direction to the side with the ventral surface 3C formed from the contact angle portion 3A is referred to as a width direction.

Moreover, for the sake of convenience, FIG. 1 illustrates the direction in which the image holding member (photoreceptor drum) 31 is driving with the arrow A, but FIG. 1 shows a state in which the image holding member 31 is stopped.

FIG. 1 is a view schematically illustrating the cleaning blade according to a first exemplary embodiment and is also a view illustrating a state in which the cleaning blade is in contact with the surface of a photoreceptor drum which is an example of the member to be cleaned. Further, FIG. 5 is a view illustrating a state in which a cleaning blade according to a second exemplary embodiment is in contact with the surface of the photoreceptor drum and FIG. 6 is a view illustrating a state in which a cleaning blade according to a third exemplary embodiment is in contact with the surface of the photoreceptor drum.

A cleaning blade 342A according to the first exemplary embodiment illustrated in FIG. 1 is entirely formed of a single material, that is, only a polyurethane member including the portion (contact angle portion 3A) in contact with the photoreceptor drum 31.

Figure 5:
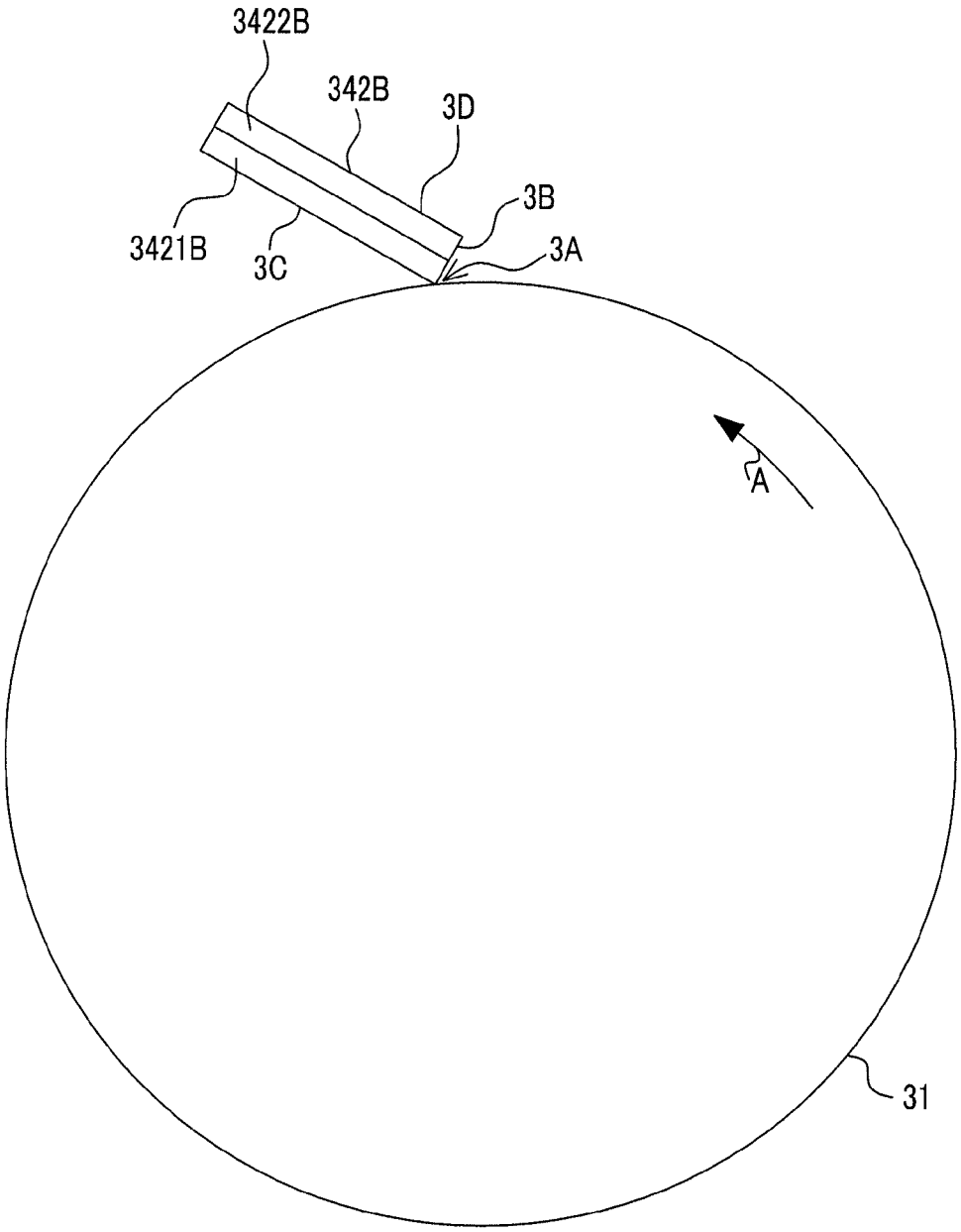
FIG. 5 is a view schematically illustrating another example of a cleaning blade according to the present exemplary embodiment.

Further, as the second exemplary embodiment illustrated in FIG. 5, the cleaning blade according to the present exemplary embodiment may have a two-layer structure of a first layer 3421B which includes the portion (contact angle portion 3A) in contact with the photoreceptor drum 31, is formed over the entire surface on the ventral surface 3C side, and formed of a polyurethane member and a second layer 3422B as a rear surface layer which is formed on a rear surface 3D side in relation to the first layer and formed of a material different from the polyurethane member.

Figure 6:
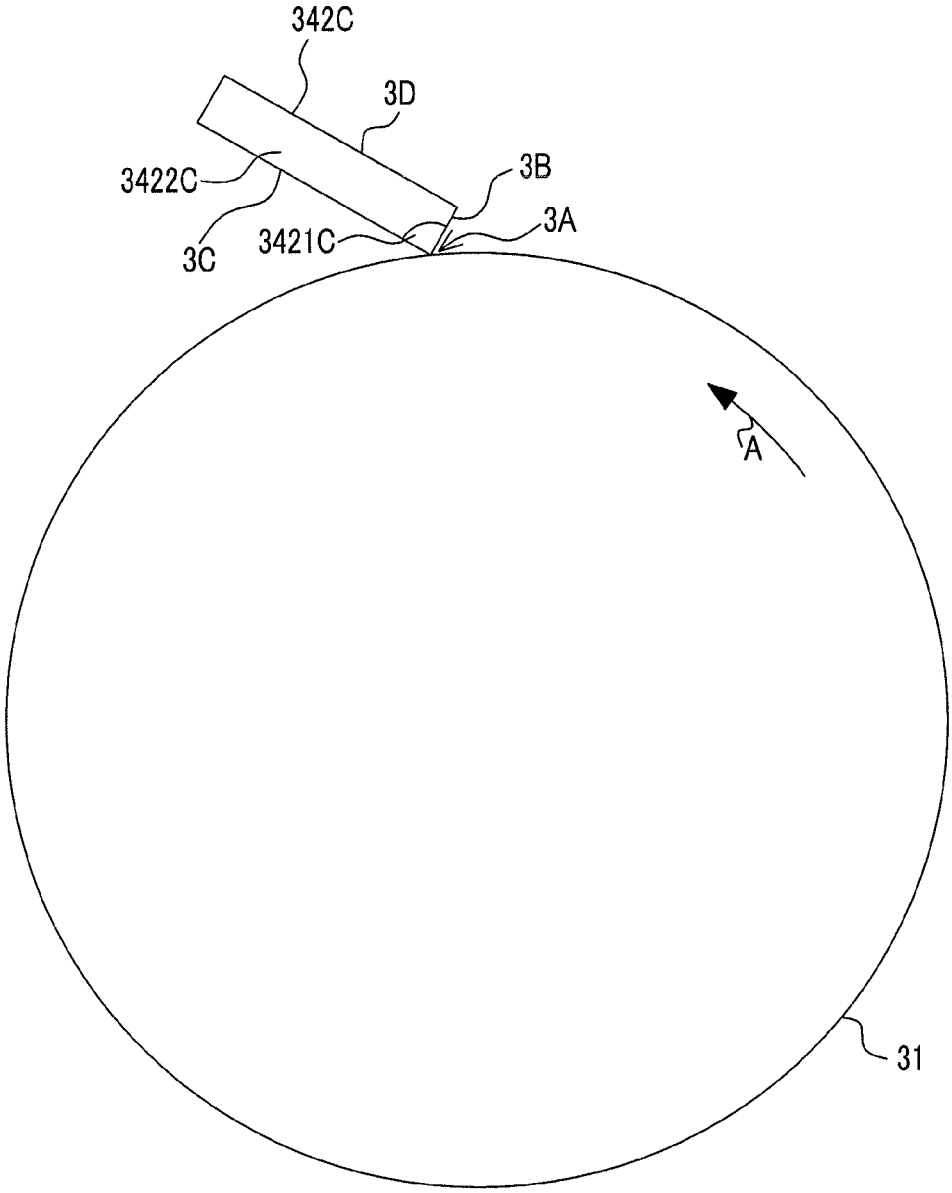
FIG. 6 is a view schematically illustrating still another example of a cleaning blade according to the present exemplary embodiment.

In addition, as the third exemplary embodiment illustrated in FIG. 6, the cleaning blade according to the present exemplary embodiment may have a configuration with a contact member (edge member) 3421C formed of a polyurethane member, which includes the portion, that is, the contact angle portion 3A in contact with the photoreceptor drum 31 and which has a shape of a cylinder cut into one fourth and being extended in the depth direction and a right-angled portion thereof forms the contact angle portion 3A; and a rear surface member 3422C formed of a material different from the polyurethane member, which covers the rear surface 3D side of the contact member 3421C in the thickness direction and the opposite side of the tip surface 3B thereof in the width direction, that is, constitutes a portion other than the contact member 3421C.

Further, FIG. 6 illustrates the example of a member having a cylindrical shape cut into one fourth as the contact member, but the contact member is not limited thereto. The contact member may have a shape in which an elliptical cylinder is cut into one fourth, a shape of a square quadrangular prism, or a shape of a rectangular quadrangular prism.

Polyurethane Member

Resin

The polyurethane member in the cleaning blade according to the present exemplary embodiment preferably contains a polyurethane material (polyurethane rubber) and more preferably contains highly crystallized polyurethane rubber.

Polyurethane rubber is synthesized by generally polymerizing polyisocyanate and polyol. Further, a resin having a functional group which may be reacted with an isocyanate group may be used in addition to polyol. Further, polyurethane rubber includes a hard segment and a soft segment.

Here, the terms "hard segment" and "soft segment" mean that the material constituting the hard segment is formed of a material relatively harder than the material constituting the soft segment and the material constituting the soft segment is formed of a material relatively softer than the material constituting the hard segment in a resin.

A combination of a material constituting the hard segment (hard segment material) and a material constituting the soft segment (soft segment material) is not particularly limited and a combination of a material which is relatively harder than the other and a material which is relatively softer than the other may be selected from known resin materials, but the following combinations are preferable in the present exemplary embodiment.

Soft Segment Material

First, examples of soft segment materials include polyol such as polyester polyol (for example, polybuthylene adipate) obtained through dehydration condensation between a diol and dibasic acid; polycarbonate polyol obtained by reacting a diol and alkyl carbonate; polycaprolactone polyol; or polyether polyol. Further, examples of commercially available products of the above-described polyols used as the materials of the soft segment include PLACCEL 205, PLACCEL 240, and PLACCEL 260 (all manufactured by Daicel Chemical Industries, Inc.), and NIPPORAN 4009 (manufactured by Nippon Polyurethane Industry Co., Ltd.). These may be used alone or in combination of two or more kinds thereof.

Hard Segment Material

As a material of the hard segment, a chain extender is preferably used.

Examples of the chain extender, which is not particularly limited as long as the chain extender is a known agent in the related art, include polyol having a molecular amount of 300 or less such as 1,4-butanediol (1,4-BD), ethylene glycol (EG), diethylene glycol, 1,3-propanediol (PD), propylene glycol, dipropylene glycol, hexanediol, 1,4-cyclohexanediol, 1,4-cyclohexane dimethanol, xylene glycol, triethylene glycol, trimethylol propane (TMP), glycerin, pentaerythritol, sorbitol, or 1,2,6-hexanetriol. These may be used alone or in combination of two or more kinds thereof.

In addition, as a material of the hard segment, a resin having a functional group which may be reacted with respect to an isocyanate group is preferably used. Further, a resin having flexibility is preferable and an aliphatic resin having a linear chain structure is more preferable in terms of flexibility. Specific preferable examples thereof include an acrylic resin having two or more hydroxyl groups, a polybutadiene resin having two or more hydroxyl groups; and an epoxy resin having two or more epoxy groups.

Examples of commercially available products of an acrylic resin having two or more hydroxyl groups include ACT FLOW (GRADE: UMB-2005B, UMB-2005P, UMB-2005, UME-2005, and the like, manufactured by Soken Chemical Co., Ltd.).

Examples of commercially available products of a polybutadiene resin having two or more hydroxyl groups include R-45HT (manufactured by Idemitsu Kosan Co., Ltd.).

As an epoxy resin having two or more epoxy groups, not an epoxy resin which is hard and brittle such as a general epoxy resin in the related art but a flexible and tough resin compared to an epoxy resins in the related art is preferable. As the above-described epoxy resin, for example, an epoxy resin having a structure (flexible skeleton) capable of improving mobility of a main chain in a main chain structure is preferable in terms of a molecular structure and examples of the flexible skeleton include an alkylene skeleton, a cycloalkane skeleton, and a polyoxy alkylene skeleton. Among these, a polyoxy alkylene skeleton is particularly preferable.

Further, in terms of physical properties, an epoxy resin with low viscosity in relation to the molecular amount is preferable compared to an epoxy resin in the related art. Specifically, the weight average molecular weight is preferably in the range of 900±100, and the viscosity at 25° C. is preferably in the range of 15000±5000 mPa·s and more preferably in the range of 15000±3000 mPa·s. Examples of the commercially available products of the epoxy resin having the above-described characteristics include EPLICON EXA-4850-150 (manufactured by DIC Corporation).

Content of Hard Segment

The content of the hard segment in the polyurethane member is preferably in the range of 40% by weight to 65% by weight, more preferably in the range of 45% by weight to 60% by weight, and still more preferably in the range of 45% by weight to 55% by weight.

When the content of the hard segment in the polyurethane member is 40% by weight or more, abrasion resistance may be obtained and an excellent cleaning property may be obtained for a long period of time. Further, when the content thereof is 65% by weight or less, flexibility or extensibility may be obtained without becoming excessively hard, generation of cracking is prevented, and an excellent cleaning property may be obtained for a long period of time.

Moreover, the weight ratio of the material constituting the hard segment to the total amount of the hard segment material and the soft segment material (hereinafter, referred to as a "ratio of the hard segment material") is preferably in the range of 10% by weight to 30% by weight, more preferably in the range of 13% by weight to 23% by weight, and still more preferably in the range of 15% by weight to 20% by weight.

When the ratio of the hard segment material is 10% by weight or more, the abrasion resistance may be obtained and an excellent cleaning property is maintained for a long period of time. Further, when the ratio of the hard segment material is 30% or less, flexibility or extensibility may be obtained without becoming excessively hard, generation of cracking is prevented, and an excellent cleaning property may be maintained for a long period of time.

Polyisocyanate

Examples of the polyisocyanate used for synthesis of polyurethane rubber include 4,4'-diphenylmethane diisocyanate (MDI), 2,6-toluene diisocyanate (TDI), 1,6-hexanediisocyanate (HDI), 1,5-naphthalene diisocyanate (NDI), and 3,3-dimethylphenyl-4,4-diisocyanate (TODI).

Further, in terms of ease of forming a hard segment aggregate having a desired size (particle diameter), 4,4'-diphenylmethane diisocyanate (MDI), 1,5-naphthalene diisocyanate (NDI), or hexamethylene diisocyanate (HDI) is more preferable as polyisocyanate.

The blending amount of polyisocyanate with respect to 100 parts by weight of a resin having a functional group which may be reacted with respect to an isocyanate group is preferably in the range of 20 parts by weight to 40 parts by weight, more preferably in the range of 20 parts by weight to 35 parts by weight, and still more preferably in the range of 20 parts by weight to 30 parts by weight.

When the blending amount thereof is 20 parts by weight or more, the bonding amount of urethane is large and the hard segment is grown, and therefore, desired hardness may be obtained. In addition, when the blending amount thereof is 40 parts by weight or less, extensibility may be obtained without the hard segment becoming excessively large and generation of cracking of the cleaning blade is prevented.

Crosslinking Agent

Examples of the crosslinking agent include a diol (difunctional), a triol (trifunctional), and a tetraol (tetrafunctional), and these may be used in combination. Further, an amine-based compound may be used as a crosslinking agent. In addition, it is preferable to use a trifunctional or higher functional crosslinking agent. Examples of the trifunctional crosslinking agent include trimethylol propane, glycerin, and triisopropanolamine.

The blending amount of the crosslinking agent with respect to 100 parts by weight of a resin having a functional group which may be reacted with respect to an isocyanate group is preferably 2 parts by weight or less. When the blending amount thereof is 2 parts by weight or less, molecular motion is not restricted by chemical crosslinking, a hard segment derived from a urethane bond due to aging is largely grown, and desired hardness may be easily obtained.

Method of Molding Polyurethane Member (Contact Member)

A general method of producing polyurethane such as a prepolymer method or a one-shot method is used for producing polyurethane rubber constituting the polyurethane member (contact member) in the present exemplary embodiment. The prepolymer method is preferable in the present exemplary embodiment because polyurethane with excellent strength and abrasion resistance may be obtained, but the present exemplary embodiment is not limited by a production method.

Such polyurethane rubber is molded by blending an isocyanate compound and a crosslinking agent with the above-described polyol. The contact member of the cleaning blade is molded by forming a composition for forming a polyurethane member (contact member) prepared by the above-described method to have a sheet shape using centrifugal molding or extrusion molding and by performing cutting processing or the like.

Here, the method of producing the polyurethane member (contact member) will be described in detail with reference to an example.

First, an isocyanate compound (for example, 4,4'-diphenylmethane diisocyanate) is added to a material (for example, polycaprolactone polyol, polyester polyol, or the like) of the soft segment to be reacted in, for example, a nitrogen atmosphere. The temperature during the reaction is preferably in the range of 60° C. to 150° C. and more preferably in the range of 70° C. to 130° C. Further, the reaction time thereof is preferably in the range of 0.1 hours to 5 hours and more preferably in the range of 1 hour to 3 hours.

Subsequently, the temperature of the reacted mixture is increased and defoamed under the reduced pressure. The temperature during the process is preferably in the range of 60° C. to 120° C. and more preferably in the range of 80° C. to 100° C. Further, the reaction time is preferably in the range of 10 minutes to 2 hours and more preferably in the range of 30 minutes to 1 hour.

Next, a chain extender (for example, ethylene glycol (EG), 1,3-propanediol (PD), or 1,4-butanediol (1,4-BD)) is mixed with the mixture as a material of the hard segment and a composition for forming a polyurethane member (contact member) is prepared.

Subsequently, the composition for forming a polyurethane member (contact member) is poured into a mold of a centrifugal molding machine and is subjected to a hardening reaction. The molding temperature during the reaction is preferably in the range of 80° C. to 160° C. and more preferably in the range of 100° C. to 140° C. Moreover, the reaction time is preferably in the range of 20 minutes to 3 hours and more preferably in the range of 30 minutes to 2 hours.

The reacted composition is aged, heated, and cooled. The temperature of the aging and heating process is preferably in the range of 70° C. to 130° C., more preferably in the range of 80° C. to 130° C., and still more preferably in the range of 100° C. to 120° C. In addition, the reaction time is preferably in the range of 1 hour to 48 hours and more preferably in the range of 10 hours to 24 hours.

Further, in order for the ratio of an area occupied by the hard segment aggregate having a diameter of 0.3 μm to 0.7 μm in the present exemplary embodiment to be in the above-described range, it is preferable to further provide a post-heating process from a viewpoint of controlling aggregation in the hard segment. The degree of aggregation of the hard segment is adjusted by adjusting the heating temperature and the time during the post-heating process.

The heating temperature of the post-heating process is preferably in the range of 90° C. to 140° C., more preferably in the range of 100° C. to 120° C., and still more preferably in the range of 105° C. to 115° C. Further, the heating time is preferably in the range of 20 minutes to 60 minutes, more preferably in the range of 30 minutes to 50 minutes, and still more preferably in the range of 35 minutes to 45 minutes.

In addition, in a case where the cleaning blade is formed of only the contact member as illustrated in FIG. 1, the cleaning blade is formed by cutting the contact member into a determined shape before or after the post-heating process.

Tan δ Peak Temperature

The peak temperature of tan δ (loss tangent) in the polyurethane member of the cleaning blade represents the glass transition temperature (Tg).

The tan δ peak temperature of the polyurethane member in the present exemplary embodiment is preferably in the range of −30° C. to 5° C., more preferably in the range of −25° C. to 2° C., and still more preferably in the range of −20° C. to 0° C.

When the tan δ peak temperature is 5° C. or lower, the polyurethane member becomes excellent in low-temperature characteristics and crack resistance property. In addition, when the tan δ peak temperature is −30° C. or higher, there are advantages in that tan δ is not excessively decreased at room temperature, moderate impact resilience is maintained, and vibration thereof does not become excessive.

Here, the tan δ peak temperature is derived from a storage elastic modulus and a loss elastic modulus described below. When a distortion of the sine wave is applied to a linear elastic member in a stationary vibration manner, the stress is represented by an equation (A). Further, |E*| is referred to as a complex elastic modulus. Further, based on the rheological theory, an elastic member component is represented by an equation (B) and a viscous member component is represented by an equation (C). Here, E' is referred to as a storage elastic modulus and E" is referred to as a loss elastic modulus. δ represents a phase difference angle between the stress and the distortion and is referred to as a "mechanical loss angle." The value of tan δ is represented by E"/E' as shown in an equation (D) and is referred to as "loss sine," and the linear elastic member has rubber elasticity as the value thereof becomes larger.

$$\sigma=|E^*|\gamma\cos(\omega t) \quad \text{Equation (A)}$$

$$E'=|E^*|\cos\delta \quad \text{Equation (B)}$$

$$E''=|E^*|\sin\delta \quad \text{Equation (C)}$$

$$\tan\delta=E''/E' \quad \text{Equation (D)}$$

The value of tan δ is measured at a still distortion of 5% using Rheospectoler DVE-V4 (manufactured by Rheology Ltd.) and sine wave tensile excitation at 10 Hz in a temperature range of −60° C. to 100° C.

The tan δ peak temperature in the polyurethane member tends to be increased because of, for example, decrease in molecular weight of polyol and tends to be increased because of an increase in the amount of crosslinking agent. However, the adjustment of the tan δ peak temperature is not limited to the above-described method.

100% Modulus

The 100% modulus of the polyurethane member is preferably 6 MPa or more, more preferably 7 MPa or more, and still more preferably 7.5 MPa or more. In addition, the upper limit of the 100% modulus is, for example, 11 MPa or lower, and more preferably 10 MPa or lower.

When the 100% modulus is 6 MPa or more, appropriate hardness may be obtained and the abrasion resistance becomes excellent.

Here, the 100% modulus is a value measured in conformity with J1S K 6251 (in 2004). That is, measurement is performed at a tensile speed of 500 mm/min using a test piece in a shape of a dumbbell No. 3 and a stress-distortion curve is obtained (environmental temperature of 23° C.) and the 100% modulus may be obtained based on the curve. Further, as a measuring device, STROGRAPH AE ELASTOMER (manufactured by Toyo Seiki Co., Ltd.) is used.

Non-Contact Member

Next, the composition of a non-contact member in the cleaning blade of the present exemplary embodiment, will be described in a case where the contact member and a region other than the contact member (non-contact member) are respectively formed of materials different from each other similar to the second exemplary embodiment illustrated in FIG. 5 or the third exemplary embodiment illustrated in FIG. 6.

For the non-contact member in the cleaning blade according to the present exemplary embodiment, any known materials may be used without being particularly limited.

Examples of materials used for the non-contact member include polyurethane rubber, silicon rubber, fluorine rubber, chloroprene rubber, and butadiene rubber. Among these, polyurethane rubber is preferable. As the polyurethane rubber, ester-based polyurethane or ether-based polyurethane may be exemplified and ester-based polyurethane is particularly preferable.

Further, when polyurethane rubber is produced, a method of using polyol and polyisocyanate may be used.

Examples of polyol include polytetramethyl ether glycol, polyethylene adipate, and polycaprolactone.

Examples of polyisocyanate include 2,6-toluene diisocyanate (TDI), 4,4'-diphenylmethane diisocyanate (MDI), paraphenylene diisocyanate (PPDI), 1,5-naphtahlene diisocyanate (NDI), and 3,3-dimethyldiphenyl-4,4'-diisocyanate (TODI). Among these, MDI is preferable.

Further, examples of a curing agent that allows polyurethane to be cured include curing agents such as 1,4-butanediol, trimethylol propane, ethylene glycol, and a mixture of these.

When the description is made with reference to a specific example, polyurethane obtained by the following procedures is preferable used: 1,4-butanediol and trimethylol propane are preferably combined as a curing agent and used with a prepolymer formed by mixing diphenylmethane-4,4-diisocyanate to polytetramethyl ether glycol which is subjected to a dehydration treatment to be reacted. Further, an additive such as a reaction modifier may be added.

As a method of preparing the non-contact member, a known method in the related art is used according to raw materials used for preparation. For example, the non-contact member is formed using centrifugal molding or extrusion molding and prepared by performing cutting processing into a determined shape.

Production of Cleaning Blade

In a case of the cleaning blade formed of only the contact member illustrated in FIG. 1, a cleaning blade is produced using a method of molding the above-described contact member.

Further, in a case of the cleaning blade having a multilayer structure such as a two-layer structure illustrated in FIG. 5, a cleaning blade may be prepared by attaching a first layer as the contact member and a second layer as the non-contact member (plural layers in a case of a structure having three or more layers) to each other. As the attaching method, a double-sided tape or various adhesives may be appropriately used. Further, plural layers may be adhered to one another by pouring materials of respective layers to a mold by placing a time difference during molding and bonding materials without providing an adhesive layer.

Further, in a case of the configuration having the contact member (edge member) and the non-contact member (rear surface member) illustrated in FIG. 6, a first mold having a cavity (region of pouring a composition for forming the contact member) corresponding to a semicylindrical shape in which two contact members 3421C illustrated in FIG. 6 are overlapped with each other on the ventral surface 3C side and a second mold having a cavity corresponding to a shape in which two contact members 3421C and non-contact members 3422C are overlapped with each other on the ventral surface 3C side are prepared. A first molded material having a shape in which two contact members 3421C are overlapped with each other is formed by pouring the composition for forming the contact member to the cavity of the first mold followed by curing. Next, the first mold is removed and then the second mold is disposed such that the first molded material is arranged in the inside of the cavity in the second mold. Subsequently, the composition for forming the non-contact member is poured into the cavity of the second mold so as to cover the first molded material, and the composition is cured, and then a second molded material having a shape in which two contact members 3421C and non-contact members 3422C are overlapped with each other on the ventral surface 3C side is formed. Next, the formed second molded material is cut in a central portion, that is, on the ventral surface 3C, the contact member having a semicylindrical shape is divided in the central portion and cut to have a cylindrical shape cut into one fourth, and then a cleaning blade illustrated in FIG. 6 is obtained by performing cutting into a determined dimension.

Usage

In a case where a member to be cleaned is cleaned using the cleaning blade of the present exemplary embodiment, the member to be cleaned, which is a cleaning target, is not particularly limited as long as the member needs cleaning of the surface. In a case where it is used for an image forming apparatus, a detoning roll that removes a toner from a cleaning brush removing the toner from an intermediate transfer member, a charging roll, a transfer roll, a transferred material transport belt, a paper feeding roll, and image holding member may be exemplified. In the present exemplary embodiment, an image holding member is particularly preferable.

Cleaning Device, Process Cartridge, and Image Forming Apparatus

Next, a cleaning device using the cleaning blade of the present exemplary embodiment, a process cartridge, and an image forming apparatus will be described.

The cleaning device of the present exemplary embodiment is not particularly limited as long as the cleaning blade of the present exemplary embodiment is included as a cleaning blade that performs cleaning of the surface of the member to be cleaned by being brought into contact with the surface of the member to be cleaned. For example, as an example of the configuration of the cleaning device, a configuration in which the cleaning blade is fixed in a cleaning case having an opening portion on the side of the member to be cleaned such that an edge tip becomes an opening portion side and a transporting member is provided which introduces foreign matter such as waste toners collected from the surface of the member to be cleaned to a container for collected foreign matter by the cleaning blade may be exemplified. Further, in the cleaning device of the present exemplary embodiment, two or more cleaning blades of the present exemplary embodiment may be used.

Further, in a case where the cleaning blade of the present exemplary embodiment is used for cleaning of the image holding member, in order to prevent image deletion during image formation, a normal force (NF) of pressing the cleaning blade to the image holding member is preferably in the range of 1.3 gf/mm to 2.3 gf/mm and more preferably in the range of 1.6 gf/mm to 2.0 gf/mm.

Further, the length in which the tip portion of the cleaning blade bites into the image holding member is preferably in the range of 0.8 mm to 1.2 mm and more preferably in the range of 0.9 mm to 1.1 mm.

A working angle (W/A) in the contact portion between the cleaning blade and the image holding member is preferably in the range of 8° to 14° and more preferably in the range of 10° C. to 12°.

The process cartridge of the present exemplary embodiment is not particularly limited as long as the cleaning device of the present exemplary embodiment is included as a cleaning device that performs cleaning of the surface of the member to be cleaned by being brought into contact with the surface of one or more of the members to be cleaned such as the image holding member or the intermediate transfer member, and examples thereof include a process cartridge including an image holding member and the cleaning device of the present exemplary embodiment that performs cleaning of the surface of the image holding member and being detachable from an image forming apparatus. For example, when a so-called tandem machine including an image holding member corresponding to toners of respective colors is used, the cleaning devices of the present exemplary embodiment may be provided for each of the image holding members. In addition, a cleaning brush or the like may be used in combination in addition to the cleaning device of the present exemplary embodiment.

The image forming apparatus according to the present exemplary embodiment includes an image holding member, a charging device that charges the image holding member, an electrostatic latent image forming device that forms an electrostatic latent image on a surface of a charged image holding member, a developing device that develops the electrostatic latent image formed on the surface of the image holding member using a toner to form a toner image, a transfer device that transfers the toner image formed on the image holding member to a recording medium, and a cleaning device that performs cleaning by bringing the cleaning blade according to claim 1 into contact with the surface of the image holding member after the toner image is transferred by the transfer device.

—Specific Examples of Cleaning Blade, Image Forming Apparatus, and Cleaning Device—

Next, specific examples of the cleaning blade of the present exemplary embodiment, and the image forming apparatus and the cleaning device using the cleaning blade will be described in detail with reference to the accompanying drawings.

Figure 3:
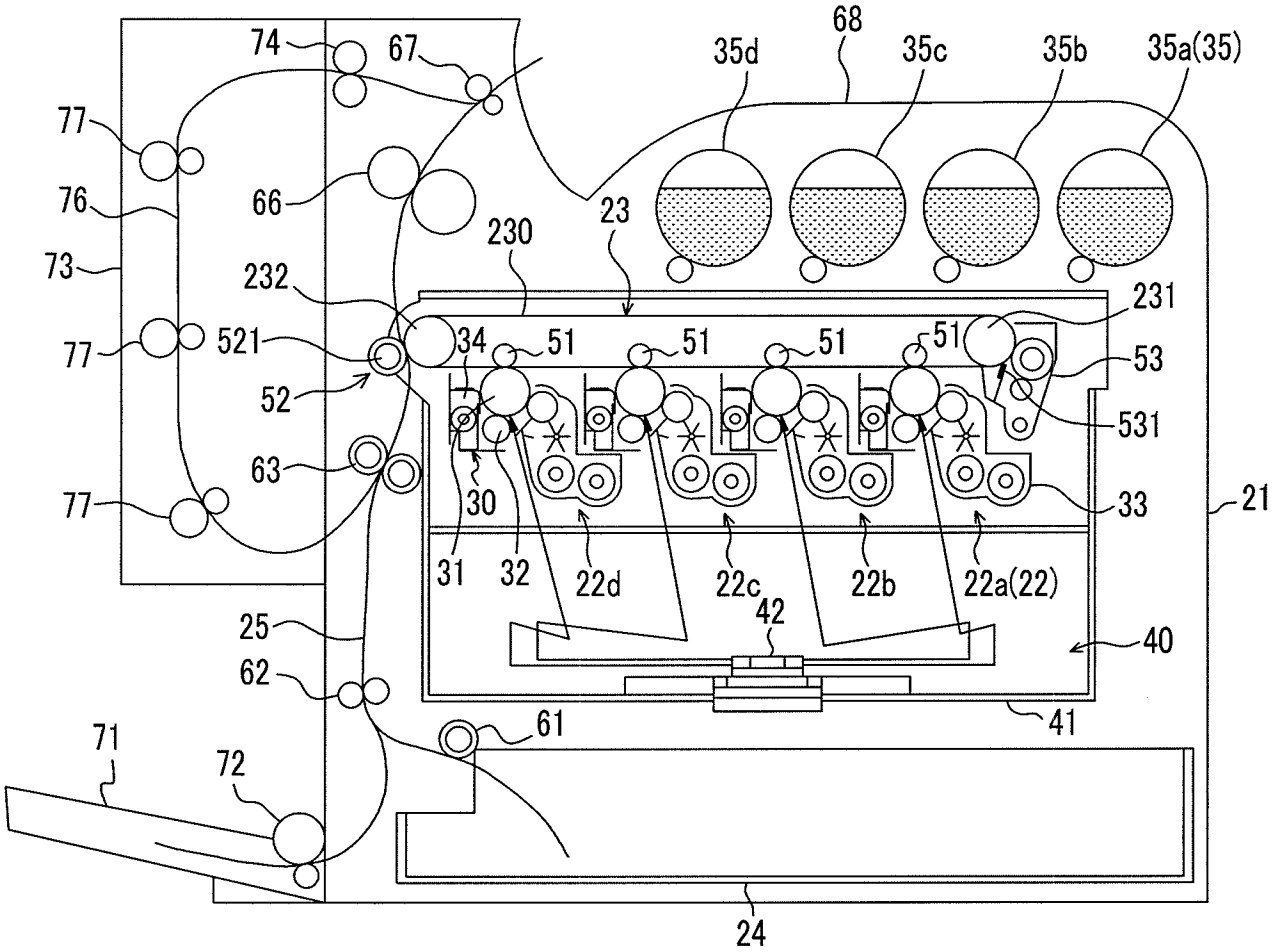
FIG. 3 is a view schematically illustrating an example of an image forming apparatus according to the present exemplary embodiment.

FIG. 3 is a view schematically illustrating an example of the image forming apparatus according to the present exemplary embodiment and illustrates a so-called tandem type image forming apparatus.

In FIG. 3, the reference numeral 21 is a main body housing, the reference numerals 22 and 22*a* to 22*d* are imaging units, the reference numeral 23 is a belt module, the reference numeral 24 is a recording medium supply cassette, the reference numeral 25 is a recording medium transport path, the reference numeral 30 is a photoreceptor unit, the reference numeral 31 is a photoreceptor drum, the reference numeral 33 is a developing unit, the reference numeral 34 is a cleaning device, the reference numerals 35 and 35*a* to 35*d* are toner cartridges, the reference numeral 40 is an exposure unit, the reference numeral 41 is a unit case, the reference numeral 42 is a polygon mirror, the reference numeral 51 is a primary transfer device, the reference numeral 52 is a secondary transfer device, the reference numeral 53 is a belt cleaning device, the reference numeral 61 is a delivery roll, the reference numeral 62 is a feeding roll, the reference numeral 63 is a positioning roll, the reference numeral 66 is a fixing device, the reference numeral 67 is a discharge roll, the reference numeral 68 is a paper discharge unit, the reference numeral 71 is a manual feed supply device, the reference numeral 72 is a delivery roll, the reference numeral 73 is a double-sided recording unit, the reference numeral 74 is a guide roll, the reference numeral 76 is a transport path, the reference numeral 77 is a feeding roll, the reference numeral 230 is an intermediate transfer belt, the reference numerals 231 and 232 are support rolls, the reference numeral 521 is a secondary transfer roll, and the reference numeral 531 is a cleaning blade.

In the tandem type image forming apparatus illustrated in FIG. 3, the imaging units 22 (specifically, 22*a* to 22*d*) having four colors (yellow, magenta, cyan, and black in the present exemplary embodiment) are arranged in the main body housing 21, a belt module 23 including the intermediate transfer belt 230 that is circulated and transported along the arrangement direction of the respective imaging units 22 is disposed in the upper portion of the main body housing 21, the recording medium supply cassette 24 accommodating a recording medium (not illustrated) such as paper is disposed in the lower portion of the main body housing 21, and the recording medium transport path 25 which is a transport path of the recording medium from the recording medium supply cassette 24 is arranged in the vertical direction.

In the present exemplary embodiment, respective imaging units 22 (22*a* to 22*d*) form toner images for yellow, magenta, cyan, and black (the arrangement is not necessarily limited to this order) in order from the upstream side of the intermediate transfer belt 230 in the circulation direction and include one exposure unit 40 common in the respective photoreceptor units 30 and the respective developing units 33.

Here, the photoreceptor unit 30 is formed as sub-cartridges by integrally combining the photoreceptor drum 31, the charging device (charging roll) 32 that charges the photoreceptor drum 31 in advance, and the cleaning device 34 that removes a residual toner on the photoreceptor drum 31.

Further, the developing unit 33 develops an electrostatic latent image formed on a charged photoreceptor drum 31 and exposed by the exposure unit 40 using a corresponding color toner (for example, negative polarity in the present exemplary embodiment) and constitutes a process cartridge (so-called Customer Replaceable Unit) by being integrated with a sub-cartridge formed of the photosensitive unit 30.

Further, the photoreceptor unit 30 may be certainly used as a process cartridge independent from the developing units 33. In addition, in FIG. 3, the reference numerals 35 (35*a* to 35*d*) are toner cartridges for replenishing toners having respective color components to respective developing units 33 (paths for replenishing toners are not illustrated).

In addition, the exposure unit 40 stores four semiconductor lasers (not illustrated), one polygon mirror 42, an imaging lens (not illustrated), and respective mirrors (not illustrated) corresponding to the respective photoreceptor units 30 in the unit case 41, performs deflection scanning of the light from the semiconductor lasers for each color component using the polygon mirror 42, and arranges an optical image so as to be guided to an exposure point on the corresponding photoreceptor drum 31 through the imaging lens and the mirrors.

Further, in the present exemplary embodiment, the belt module 23 is obtained by stretching the intermediate transfer belt 230 between a pair of support rolls 231 and 232 (one of them is a driving roll), a primary transfer device (in the present example, the primary transfer roll) 51 is disposed on the rear surface of the intermediate transfer belt 230 corresponding to the photoreceptor drum 31 of the respective photoreceptor units 30, and a toner image on the photoreceptor drum 31 is electrostatically transferred to the intermediate transfer belt 230 side by applying a voltage having a polarity which is the opposite to the charging polarity of the toner to the primary transfer device 51. Further, the secondary transfer device 52 is disposed in a portion corresponding to the support roll 232 on the downstream side of the imaging unit 22*d* on the most downstream side of the intermediate transfer belt 230 and secondarily transfers (batch transfer) a primary transfer image on the intermediate transfer belt 230 to a recording medium.

In the present exemplary embodiment, the secondary transfer device 52 includes a secondary transfer roll 521 that is arranged on a toner image holding surface side of the intermediate transfer belt 230 in a press-contact manner and a rear surface roll (in the present example, the support roll 232 is used also as the rear surface roll) that is arranged on the rear surface side of the intermediate transfer belt 230 and act as a counter electrode of the secondary transfer roll 521. Further, for example, the secondary transfer roll 521 is grounded and a bias having the same polarity as the charging polarity of the toner is applied to the rear surface roll (support roll 232).

Further, a belt cleaning device 53 is disposed on the upstream side of the most upstream side imaging unit 22*a* of the intermediate transfer belt 230 and a residual toner on the intermediate transfer belt 230 is removed.

Further, the delivery roll 61 that delivers a recording medium is provided in the recording medium supply cassette 24, the feeding roll 62 that delivers the recording medium is disposed just after the delivery roll 61, and the positioning roll 63 that supplies the recording medium to a secondary transfer site at a determined timing is disposed in the recording medium transport path 25 positioned just before the secondary transfer site. Further, the fixing device 66 is provided in the recording medium transport path 25 positioned on the downstream side of the secondary transfer site, the discharge roll 67 for discharging the recording medium is provided on the downstream side of the fixing device 66, and a discharged recording medium is accommodated in the paper discharge unit 68 formed on the upper portion of the main body housing 21.

Further, in the present exemplary embodiment, the manual feed supply device (MSI) 71 is provided on the lateral side of the main body housing 21, and the recording medium on the manual feed supply device 71 is delivered toward the recording medium transport path 25 by the delivery roll 72 and the feeding roll 62.

Further, the double-sided recording unit 73 is disposed on the main body housing 21. When a double-sided mode for performing image recording on both sides of the recording medium is selected, the double-sided recording unit 73 reverses the discharge roll 67 and takes the recording medium whose one side is finished recording therein with the guide roll 74 on the front of the entrance, transports the recording medium along the recording medium return transport path 76 provided therein using the feeding roll 77, and supplies the recording medium to the positioning roll 63 side again.

Next, the cleaning device 34 arranged in the tandem type image forming apparatus illustrated in FIG. 3 will be described.

Figure 4:
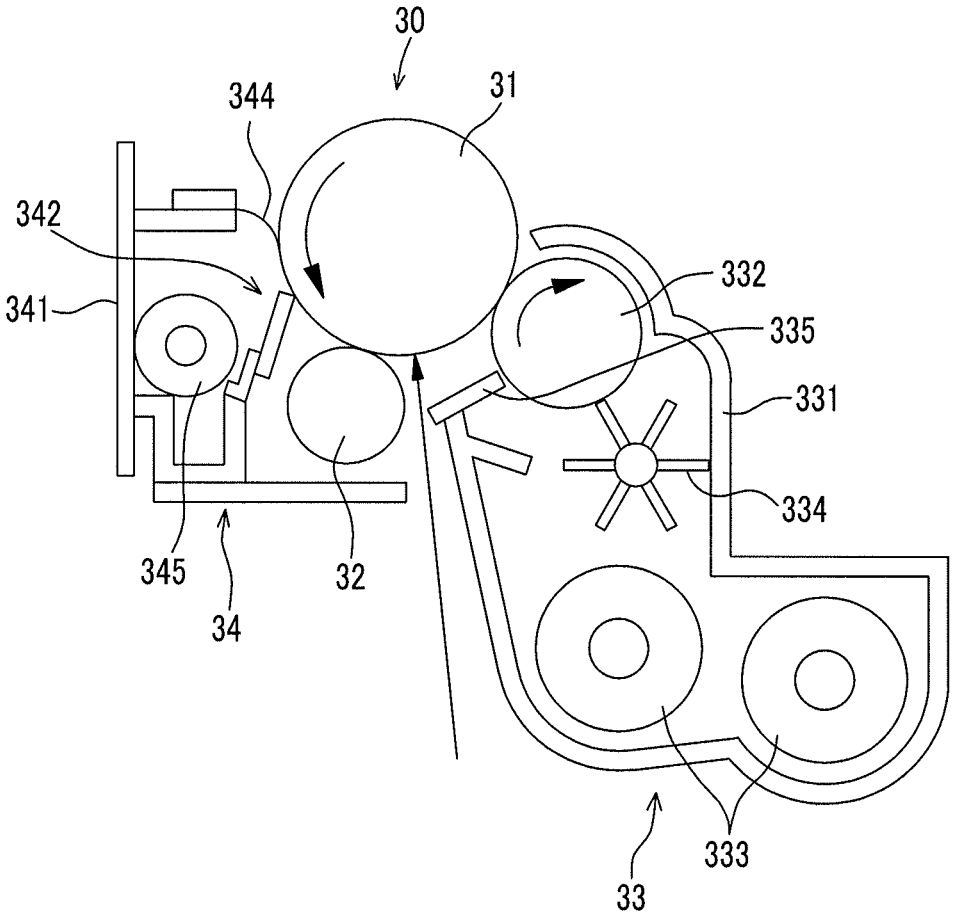
FIG. 4 is a cross-sectional view schematically illustrating an example of a cleaning device according to the present exemplary embodiment.

FIG. 4 is a view schematically illustrating an example of the cleaning device of the present exemplary embodiment and also illustrates the photoreceptor drum 31, the charging roll 32, and the developing unit 33 which are made into a sub-cartridge together with the cleaning device 34 illustrated in FIG. 3.

In FIG. 4, the reference numeral 32 indicates a charging roll (charging device), the reference numeral 331 indicates a unit case, the reference numeral 332 indicates a developing roll, the reference numeral 333 indicates a toner transport member, the reference numeral 334 indicates a transport paddle, the reference numeral 335 indicates a developer quantity regulating member, the reference numeral 341 indicates a cleaning case, the reference numeral 342 indicates a cleaning blade, the reference numeral 344 indicates a film seal, and the reference numeral 345 indicates a transport member.

The cleaning device 34 includes the cleaning case 341 that accommodates the residual toner and is opened while facing the photoreceptor drum 31, the cleaning blade 342 arranged in contact with the photoreceptor drum 31 is attached to the lower edge of the opening of the cleaning case 341 through a bracket (not illustrated), and the film seal 344 with which contact with the photoreceptor drum 31 is airtightly maintained is attached to the upper edge of the opening of the cleaning case 341. Further, the reference numeral 345 is a transport member that guides waste toners accommodated in the cleaning case 341 to a waste toner container on the lateral side.

Moreover, in all cleaning devices 34 of respective imaging units 22 (22*a* to 22*d*), the cleaning blade of the present exemplary embodiment is used as the cleaning blade 342 and the cleaning blade of the present exemplary embodiment may be also used as the cleaning blade 531 used in the belt cleaning device 53.

In addition, the developing unit (developing device) 33 used in the present exemplary embodiment includes the unit case 331 which accommodates a developer and is opened while facing the photoreceptor drum 31 as illustrated in FIG. 4. Here, the developing roll 332 is disposed in a portion facing the opening of the unit case 331 and the toner transport member 333 for stirring and transporting a developer is disposed in the unit case 331. Further, the transport paddle 334 may be disposed between the developing roll 332 and the toner transport member 333.

At the time of developing, a developer is supplied to the developing roll 332 and then transported to a developing region facing the photoreceptor drum 31 in a state in which the layer thickness of the developer is regulated in the developer quantity regulating member 335.

In the present exemplary embodiment, a two-component developer formed of a toner and a carrier is used as the developing unit 33, but a single-component developer formed of only a toner may be used as the developing unit 33.

Next, an operation of the image forming apparatus according to the present exemplary embodiment will be descried. First, when respective imaging units 22 (22*a* to 22*d*) form monochromatic toner images corresponding to respective colors, the monochromatic toner images corresponding respective colors are sequentially superimposed on the surface of the intermediate transfer belt 230 so as to be matched with original document information and primarily transferred. Subsequently, color toner images transferred to the surface of the intermediate transfer belt 230 are transferred to the surface of the recording medium in the secondary transfer device 52, the recording medium to which the color toner images are transferred is subjected to a fixing treatment by the fixing device 66 and then discharged to the paper discharge unit 68.

In addition, in the respective imaging unit 22 (22*a* to 22*d*), the residual toner on the photoreceptor drum 31 is cleaned by the cleaning device 34 and the residual toner on the intermediate transfer belt 230 is cleaned by the belt cleaning device 53.

In this imaging process, the respective residual toners are cleaned by the cleaning device 34 (or the belt cleaning device 53).

In addition, the cleaning blade 342 is not directly fixed to a frame member in the cleaning device 34 as illustrated in FIG. 4, but may be fixed through a spring material.

EXAMPLES

Hereinafter, the present invention will be described with reference to Examples, but the present invention is not limited thereto. Further, "parts" in the description below means "parts by weight."

Example 1

Preparation of Cleaning Blade Main Body

Polycaprolactone polyol (soft segment material, PLACCEL 260, manufactured by Daicel Chemical Industries, Inc., average molecular weight: 5400, hydroxyl value: 20.7 KOHmg/g) and polybuthylene adipate (soft segment material, polyester polyol, NIPPORAN 4009, manufactured by Nippon Polyurethane Industry Co., Ltd., average molecular weight: 1000, hydroxyl value: 112.2 KOHmg/g) are used as polyol components. The mixing ratio of PLACCEL 260 to NIPPORAN 4009 is set to 2:1 (molar ratio). Respective polyol components are dissolved and dehydrated at 80° C. and PLACCEL 260 and NIPPORAN 4009 are mixed with the above-described molar ratio. 4,4'-diphenylmethane diisocyanate (Millionate Mont., manufactured by Nippon Polyurethane Industry Co., Ltd.) is added thereto such that the ratio of isocyanate to the total amount becomes 17 mol % to be reacted at 70° C. for 3 hours in a nitrogen atmosphere, thereby obtaining a prepolymer.

The temperature of the prepolymer is increased to 100° C. and the prepolymer is defoamed under reduced pressure for 1 hour, a mixture of ethylene glycol (EG), 1,3-propanediol (PD), 1,4-butanediol (1,4-BD) (molar ratio=3:30:45, all of them are chain extenders, hard segment materials), and trimethylol propane (0.2% by weight/total amount) is added to the prepolymer and the contents are mixed for 3 minutes, thereby preparing a composition A for forming a blade.

Next, the composition A for forming a blade is poured into a centrifugal molding machine whose temperature of a mold is adjusted to 140° C. and then subjected to a curing reaction for 1 hour. Next, the reacted composition is aged and heated at 110° C. for 24 hours and then cooled.

Further, a post-heating process is performed. The heating temperature thereof is 100° C. and the time thereof is 30 minutes. Next, resultant is cut and a cleaning blade having a length of 320 mm, a width of 12 mm, and a thickness of 2 mm is obtained.

Example 2

A cleaning blade is obtained in the same manner as that of Example 1 except that the content of the hard segments is changed to 56% and the temperature and the time of the post-heating process are respectively changed to 120° C. and 60 minutes.

Example 3

A cleaning blade is obtained in the same manner as that of Example 1 except that the content of the hard segments is changed to 47% and the temperature and the time of the post-heating process are respectively changed to 110° C. and 60 minutes.

Example 4

A cleaning blade is obtained in the same manner as that of Example 1 except that the content of the hard segments is changed to 64% and the temperature and the time of the post-heating process are respectively changed to 110° C. and 80 minutes.

Example 5

A cleaning blade is obtained in the same manner as that of Example 1 except that the content of the hard segments is changed to 50% and the temperature and the time of the post-heating process are respectively changed to 130° C. and 40 minutes.

Comparative Example 1

A cleaning blade is obtained in the same manner as that of Example 1 except that the content of the hard segments is changed to 44% and the temperature and the time of the post-heating process are respectively changed to 150° C. and 30 minutes.

Comparative Example 2

A cleaning blade is obtained in the same manner as that of Example 1 except that the content of the hard segments is changed to 43% and the temperature and the time of the post-heating process are respectively changed to 140° C. and 20 minutes.

Comparative Example 3

A cleaning blade is obtained in the same manner as that of Example 1 except that the content of the hard segments is changed to 58% and the temperature and the time of the post-heating process are respectively changed to 100° C. and 40 minutes.

Evaluation Test

—Edge Wear—

When edge wear is evaluated, the wear of the edge portion (contact angle portion) of the cleaning blade and cleaning failure are evaluated and determined after image formation using A4 paper (210×297 mm, P paper, manufactured by Fuji Xerox Co., Ltd.) until the number of integrated rotations of the photoreceptor becomes 100,000 cycles with an image forming apparatus (trade name: DocuCentre-IIC7500, manufactured by Fuji Xerox Co., Ltd.) in a high temperature and high humidity environment (28° C. and 85% RH).

Further, during the test, in order to perform evaluation under harsh conditions in which a lubricating effect is reduced in the contact portion between the photoreceptor and the cleaning blade, the image density of an image to be formed is set as 1%.

Next, when the depth of the wear of the edge portion (contact angle portion) after the test is observed using a laser microscope VK-8510 (manufactured by Keyence Corporation) from the cross-sectional side of the cleaning blade, the maximum depth of an edge missing portion on the surface side of the photoreceptor is measured.

Further, evaluation of cleaning failure is performed by feeding A3 paper on which a non-transferred solid image (size of solid image: 400 mm×290 mm) is formed between the photoreceptor and the cleaning blade after the above-described test is finished, the apparatus is stopped immediately after the rear end portion of an unfixed image in the transport direction passes through the contact portion between the photoreceptor and the cleaning blade, whether the toner passes through or not is visually inspected, and a case where passing through of the toner is confirmed is considered as cleaning failure.

Further, in a case where a portion holding back the toner is missing due to the wear or cracking of the edge portion (contact angle portion), since cleaning failure tends to be easily generated by the above-described test as the depth of the wear or the depth of the cracking of the edge are larger, the above-described test is useful for qualitative evaluation of the wear or cracking of the edge portion (contact angle portion).

TABLE 1

| Grade in evaluation of edge wear | Depth of edge wear | Cleaning failure |
|---|---|---|
| G0 | 3 μm or less<br>No trace of wear | Not generated |
| G1 | 3 μm or less | Not generated |
| G2 | More than 3 μm<br>5 μm or less | Not generated |
| G3 | More than 3 μm<br>5 μm or less | Generated |
| G4 | More than 5 μm<br>10 μm or less | Generated |
| G5 | More than 10 μm | Generated |

—Cracking—

The degree (grade) of generation of cracking is evaluated using the following method. The cleaning blade is mounted on DocuCentre-IV C5575 (manufactured by Fuji Xerox Co., Ltd.), the normal force (NF) is adjusted to 1.3 gf/mm and the working angle (W/A) is adjusted to 11°, and then printing is performed on 10,000 sheets.

The degree (grade) of generation of cracking is evaluated according to the following criteria based on the size and the number of the cracks at the time. The degree (grade) of generation of cracking is measured within 100 mm of a central portion in the axis direction.

TABLE 2

| Evaluated grade of edge cracking | Edge cracking | Cleaning failure |
|---|---|---|
| G1 | Cracking is not generated | Not generated |
| G2 | Size of crack is<br>1 μm or less<br>Number of cracks is<br>1 to less than 5 | Not generated |

TABLE 2-continued

| Evaluated grade of edge cracking | Edge cracking | Cleaning failure |
|---|---|---|
| G3 | Size of crack is 1 μm or less Number of cracks is 5 to less than 10 | Not generated |
| G4 | Size of crack is 1 μm or less Number of cracks is 10 or more | Not generated |
| G5 | Size of crack is more than 1 μm and 5 μm or less Number of cracks is 1 to less than 5 | Not generated |
| G6 | Size of crack is more than 1 μm and 5 μm or less Number of cracks is 5 to less than 10 | Generated |
| G7 | Size of crack is more than 1 μm and 5 μm or less Number of cracks is 10 or more | Generated |
| G8 | Size of crack is more than 5 μm Number of cracks is 1 to less than 5 | Generated |
| G9 | Size of crack is more than 5 μm Number of cracks is 5 to less than 10 | Generated |
| G10 | Size of crack is more than 5 μm Number of cracks is 10 or more | Generated |

—Comprehensive Evaluation—

Comprehensive evaluation is performed based on the following criteria.

A: Edge wear evaluation: G0 to G1 and cracking evaluation: G1 to G2

B: Edge wear evaluation: G2 or cracking evaluation: G3 to G5 (provided that it does not fall under C below)

C: Edge wear evaluation: G3 to G5 or cracking evaluation: G6 to G10

In addition, "HS" means a hard segment in Table 3 below.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning blade of which a contact portion brought into contact with at least a member to be cleaned is formed of a polyurethane member that includes a polyurethane material containing a hard segment and a soft segment and has a ratio of an area occupied by a hard segment aggregate having a diameter of 0.3 μm to 0.7 μm in a cross section being in a range of 2% to 10%.

2. The cleaning blade according to claim 1, wherein a ratio of an area occupied by the hard segment aggregate having a diameter of 0.3 μm to 0.7 μm is in a range of 2% to 5%.

3. The cleaning blade according to claim 1, wherein the polyurethane member has a ratio of an area occupied by a hard segment aggregate having a diameter of 0.1 μm to less than 0.3 μm in the cross section being in a range of 0.005% to 5%, and a ratio of an area occupied by a hard segment aggregate having a diameter of more than 0.7 μm being in a range of 0.005% to 3%.

4. The cleaning blade according to claim 2, wherein a ratio of an area occupied by the hard segment having a diameter of 0.1 μm to less than 0.3 μm is in a range of 0.01% to 2%.

5. The cleaning blade according to claim 2, wherein a ratio of an area occupied by the hard segment aggregate having a diameter of more than 0.7 μm is in a range OF 0.005% to 3%.

6. The cleaning blade according to claim 1, wherein a content of the hard segment in the polyurethane member is in a range of 40% by weight to 65% by weight.

TABLE 3

| | Example 1 | Example 2 | Example 3 | Example 4 | Example 5 | Comparative Example 1 | Comparative Example 2 | Comparative Example 3 |
|---|---|---|---|---|---|---|---|---|
| Ratio (%) of area occupied by HS aggregate having diameter of 0.3 μm to 0.7 μm | 2 | 10 | 2 | 10 | 4 | 1 | 1 | 11 |
| Ratio (%) of area occupied by HS aggregate having diameter of 0.1 μm to 0.3 μm | 0.005 | 5 | 0.005 | 3 | 2 | 0.2 | 0.5 | 0.1 |
| Ratio (%) of area occupied by HS aggregate having diameter of more than 0.7 μm | 0.005 | 3 | 1 | 1.2 | 2 | 3.2 | 2 | 0.1 |
| HS content (%) | 42 | 56 | 47 | 64 | 50 | 44 | 43 | 58 |
| Tanδ peak temperature (° C.) | 0 | 5 | −30 | −15 | −5 | −30 | −28 | 8 |
| 100% Modulus (MPa) | 6 | 7.3 | 6.5 | 7.8 | 6.8 | 5.7 | 5.5 | 7.5 |
| Edge wear | G2 | G0 | G1 | G0 | G1 | G3 | G4 | G0 |
| Edge cracking | G3 | G5 | G0 | G1 | G2 | G1 | G1 | G8 |
| Comprehensive evaluation | B | B | A | A | A | C | C | C |

7. The cleaning blade according to claim 1, wherein a content of the hard segment in the polyurethane member is in a range of 45% by weight to 55% by weight.

8. The cleaning blade according to claim 1, wherein a tan δ peak temperature of the polyurethane member is in a range of −30° C. to 5° C.

9. The cleaning blade according to wherein a 100% modulus of the polyurethane member is 6 MPa or more.

10. The cleaning blade according to claim 1, wherein a 100% modulus of the polyurethane member is 7.5 MPa or more.

11. A process cartridge comprising:

a cleaning device that includes the cleaning blade according to claim 1, wherein the process cartridge is detachable from an image forming apparatus.

12. An image forming apparatus comprising:

an image holding member;

a charging device that charges the image holding member;

an electrostatic latent image forming device that forms an electrostatic latent image on a surface of a charged image holding member;

a developing device that develops the electrostatic latent image formed on the surface of the image holding member using a toner to form a toner image;

a transfer device that transfers the toner image formed on the image holding member to a recording medium; and a cleaning device that performs cleaning by bringing the cleaning blade according to claim 1 into contact with the surface of the image holding member after the toner image is transferred by the transfer device.

* * * * *